US007868732B2

(12) United States Patent
Hoidis et al.

(10) Patent No.: US 7,868,732 B2
(45) Date of Patent: Jan. 11, 2011

(54) MICROVARISTOR-BASED OVERVOLTAGE PROTECTION

(75) Inventors: Markus Hoidis, Fislisbach (CH); Felix Greuter, Baden-Rütihof (CH); Lise Donzel, Wettingen (CH); Reto Kessler, Zürich (CH)

(73) Assignee: ABB Research Ltd, Zurich (CH)

( * ) Notice: Subject to any disclaimer, the term of this patent is extended or adjusted under 35 U.S.C. 154(b) by 220 days.

(21) Appl. No.: 12/255,831

(22) Filed: Oct. 22, 2008

(65) Prior Publication Data

US 2009/0045907 A1 Feb. 19, 2009

Related U.S. Application Data

(63) Continuation of application No. PCT/CH2006/000222, filed on Apr. 24, 2006.

(51) Int. Cl.
*H01C 7/10* (2006.01)

(52) U.S. Cl. ..... 338/20; 338/21; 361/127; 428/402; 428/329

(58) Field of Classification Search ..... 338/20, 338/21, 13; 361/126, 127; 428/402, 329, 428/331, 357

See application file for complete search history.

(56) References Cited

U.S. PATENT DOCUMENTS

| | | | | |
|---|---|---|---|---|
| 4,992,333 | A * | 2/1991 | Hyatt | 428/402 |
| 5,068,634 | A * | 11/1991 | Shrier | 338/21 |
| 5,183,698 | A * | 2/1993 | Stephenson et al. | 428/209 |
| 6,239,687 | B1 * | 5/2001 | Shrier et al. | 338/21 |
| 6,469,611 | B1 | 10/2002 | Kluge-Weiss et al. | |

FOREIGN PATENT DOCUMENTS

| | | |
|---|---|---|
| JP | 4-291325 A | 10/1992 |
| JP | 4-291326 A | 10/1992 |
| WO | WO 99/56290 | 11/1999 |

OTHER PUBLICATIONS

F. Greuter et al., "Microvaristors: Functional Fillers for Novel Electroceramic Composites," Journal of Electroceramics, Jul. 2004, pp. 739-744, vol. 13, No. 1-3, Kluwer Academic Publishers, The Netherlands.

International Search Report for corresponding PCT Application No. PCT/CH2006/000222, completed Sep. 8, 2006.

Written Opinion of the International Searching Authority for corresponding PCT Application No. PCT/CH2006/000222, completed Sep. 8, 2006.

International Preliminary Report on Patentability for corresponding PCT Application No. PCT/CH2006/000222, completed Apr. 3, 2008.

* cited by examiner

*Primary Examiner*—Kyung Lee
(74) *Attorney, Agent, or Firm*—Buchanan Ingersoll & Rooney PC

(57) ABSTRACT

The disclosure relates to an overvoltage protection means containing ZnO microvaristor particles for protecting electrical elements and a method to produce the means. Single microvaristor particles are placed in an arrangement having a monolayer thickness and are electrically coupled to the electrical element to protect it against overvoltages. Embodiments, among other things, relate to: 1-dimensional or 2-dimensional arrangements of microvaristor particles; placement of single microvaristors on a carrier; the carrier being planar or string-like, being structured, being a sticky tape, having fixation means for fixing the microvaristors, or having electrical coupling means. The monolayered overvoltage protection means allows very tight integration and high flexibility in shaping and adapting it to the electric or electronic element. Furthermore, reduced capacitance and hence reaction times of overvoltage protection are achieved.

63 Claims, 6 Drawing Sheets

MICROVARISTOR-BASED OVERVOLTAGE PROTECTION

RELATED APPLICATION

This application claims priority as a continuation application under 35 U.S.C. §120 to PCT/CH2006/000222 filed as an International Application on Apr. 24, 2006 designating the U.S., the entire content of which is hereby incorporated by reference in its entirety.

TECHNICAL FIELD

The disclosure relates to the field of overvoltage protection in electric and/or electronic circuitry, such as protection against lightning, electromagnetic pulses, switching surges or ground loop transients or electrostatic discharge (ESD) protection. The disclosure relates, in particular, to nonlinear electrical materials and devices for such purposes. The disclosure is based on the method for producing an overvoltage protection means, the overvoltage protection means and the electric device comprising such overvoltage protection means.

BACKGROUND INFORMATION

The disclosure starts from the prior art as described in the article by F. Greuter et al., "Microvaristors: Functional Fillers for Novel Electroceramic Composites", J. Electroceramics, 13, 739-744 (2004). Therein, varistor composites containing ZnO microvaristors embedded in a polymer matrix are disclosed for electrostatic discharge (ESD) protection of electronics. The ZnO microvaristor particles show strong nonlinearities of their electrical resistance as a function of the applied electric field. The nonlinear behaviour of the composite material depends on the microvaristor particle nonlinearities, on their packing arrangement and on the microscopic properties of the particle-particle contacts. The polymer is indispensably needed to disperse the microvaristor particles and to mold them as a viscous composite to the electronic element. After molding the composite has a macroscopic thickness and the dispersed microvaristor particles occupy a three-dimensional volume in the composite, are arranged randomly in the composite volume and form random contacts in the volume with each other. The free space between the microvaristors is filled by the polymer.

In the U.S. Pat. No. 6,239,687 B1, as in references cited therein, a nonlinear resistance material (VVRM) is used to construct variable voltage protection devices for protecting electronic circuits. The device comprises a reinforcing layer, which is impregnated with the VVRM and has a predetermined thickness, such that the device has a uniform thickness and thus reprocible electrical performance. The thickness may be controlled to macroscopic dimensions by spacers such as ceramic or glass spheres.

SUMMARY

An overvoltage protection means is disclosed, that has favourable nonlinear electrical properties and is easy to manufacture, an electric element comprising such a protection means, and a method for producing the overvoltage protection means.

An overvoltage protection means is disclosed for protecting electrical elements, wherein the protection means comprise microvaristor particles, wherein single microvaristor particles are placed in an arrangement having a monolayer thickness and are electrically coupled to the electrical element to protect the electrical element against overvoltages.

An electrical device is disclosed, comprising an electrical element having an overvoltage protection means, wherein the protection means comprise microvaristor particles, characterized in that single microvaristor particles are placed in an arrangement having a monolayer thickness and are electrically coupled to the electrical element to protect the electrical element against overvoltages.

Further embodiments, advantages and applications of the disclosure will become apparent from the following detailed description and the figures.

BRIEF DESCRIPTION OF THE DRAWINGS

Such description makes reference to the annexed drawings, which are schematically showing in FIG. 1 nonlinear electrical resistance of a known single microvaristor particle.

In the drawings identical parts are designated by identical reference numerals.

DETAILED DESCRIPTION

Figure 1:
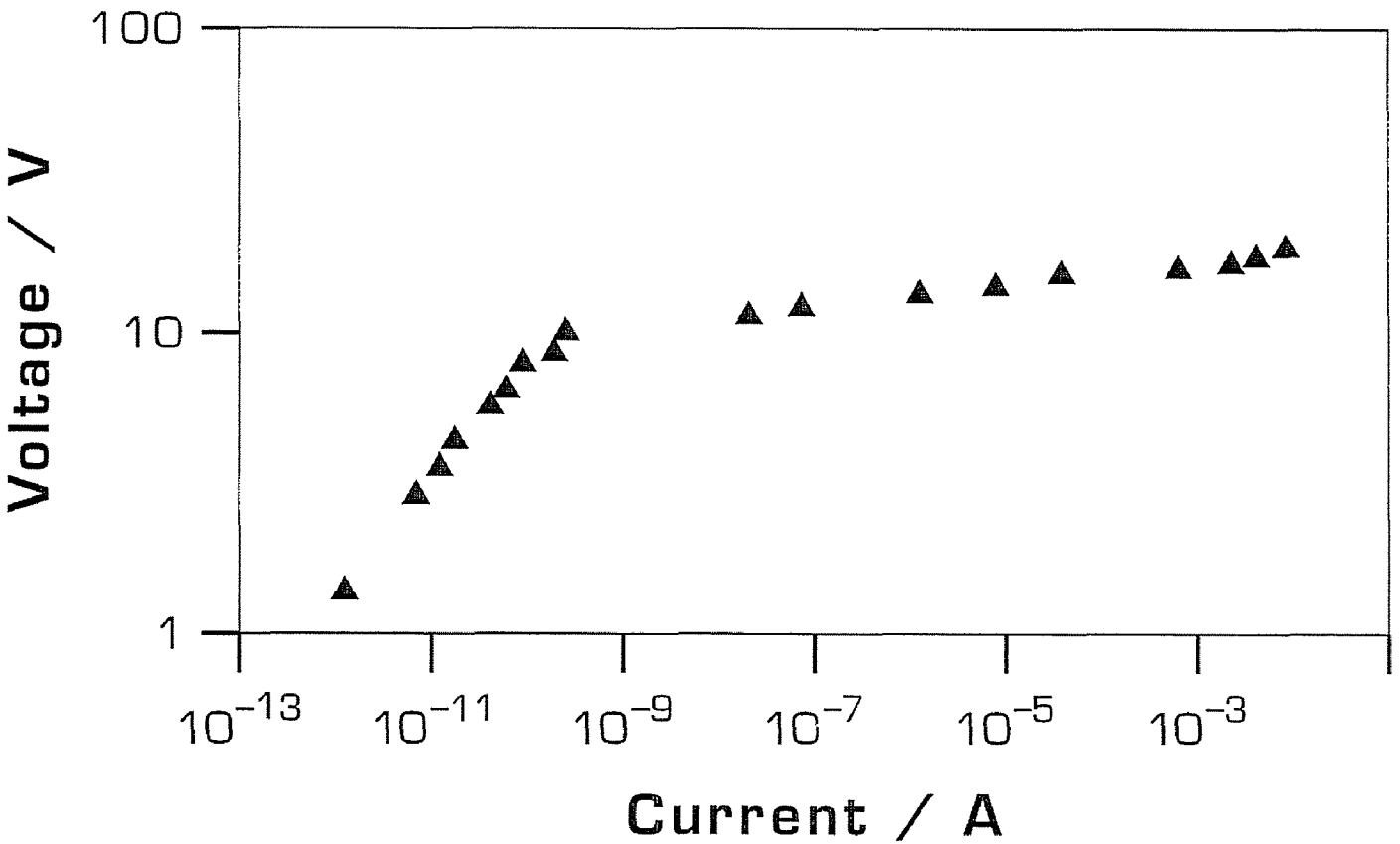
Figure 2F:
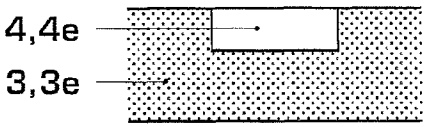
FIGS. 2*a*-2*i* embodiments of structured carriers for microvaristor arrangements according to disclosure.
Figure 2G:
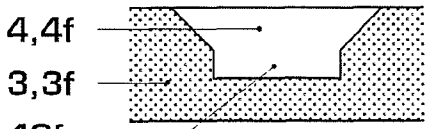
Figure 2H:
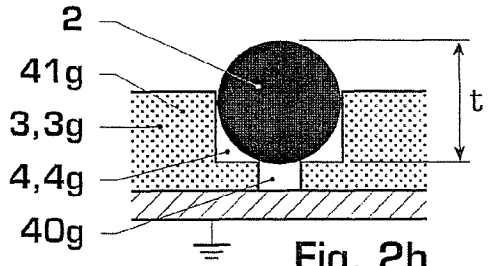
Figure 2I:
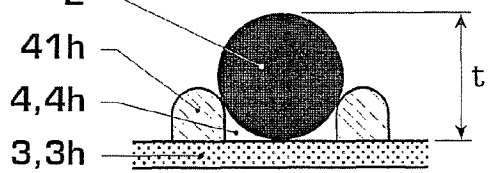
Figure 2E:
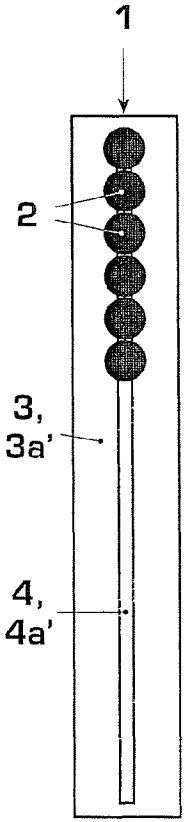
Figure 2D:
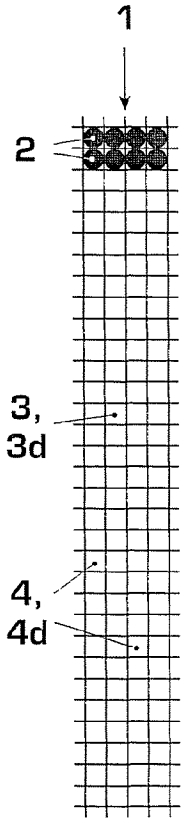
Figure 2C:
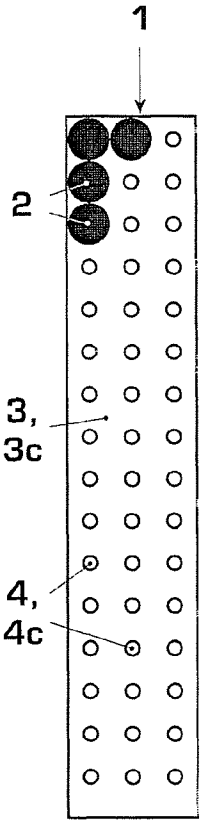
Figure 2B:
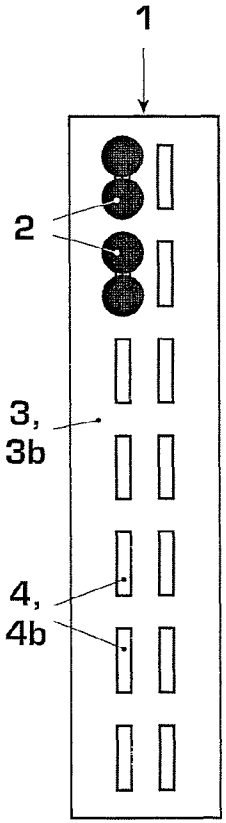
Figure 2A:
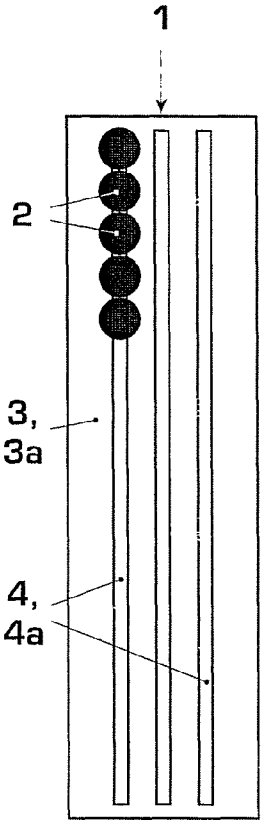

In a first aspect, an overvoltage protection means for protecting electrical elements is disclosed, the protection means comprising microvaristor particles, wherein single microvaristor particles are placed in an arrangement having a monolayer thickness and are electrically coupled to the electrical element to protect the electrical element against overvoltages.

In a second aspect, a method is disclosed for producing an overvoltage protection means for protecting electrical elements, the protection means comprising microvaristor particles, wherein single microvaristor particles are placed in an arrangement having a monolayer thickness and are electrically coupled to the electrical element to protect the electrical element against overvoltages.

The method of placing instead of molding, pouring or casting microvaristor particles allows to design overvoltage protection means for electric and electronic circuitry with an unprecedented level of precision. Thereby overvoltage protection is made more reliable and effective also on a microscopic level and, in particular, for protecting parts or elements in electronic circuits. Furthermore, the flexibility in integration of varistor overvoltage protection means in miniaturized electric or electronic equipment is strongly improved.

Mono-layered microvaristor particles allow to build high-performance overvoltage protection systems with much lower capacitance than previously known bulk varistor ceramic or composite protection means. This is due to the fact that the monolayer arrangement allows for the first time to profit from the discrete nature of the microvaristor particles which provide discrete contacting points among each other and with the electric elements to be protected. Within the monolayer the microvaristors can be placed side by side, but not on top of each other.

In exemplary embodiments variants of monolayer arrangements are disclosed, such as two-dimensional and/or one-dimensional arrangements, and/or arrangements as monolayer spacers between conductors. The great flexibility in particle placement allows to adapt the geometry of the monolayer arrangement to any desired shape of the systems to be protected. The monolayer shapes may comprise, e.g., curved or bent, completely or partially covered planes or strings or combinations thereof or virtually any desired shape of monolayer thickness.

In further exemplary embodiments variants of carriers for particle placement are disclosed, such as planar and/or longitudinal extended carriers, and/or structured carriers for providing individual placement sites for single microvaristor particles. The carriers may be decorated with guiding structures for holding the particles in place. The carriers may comprise adhesive layers to form sticky tapes, and/or may comprise fixation means for fixing the microvaristor monolayer to the tape.

In further exemplary embodiments electrical coupling means, which may be conductive, anisotropically conductive, semiconductive or insulating, are provided for electrically coupling the monolayer arrangement to an active part and a reference-potential part of the electrical component or assembly to be protected.

In a third aspect, an electrical device comprising an electrical element having such an overvoltage protection means is disclosed. The electrical element may comprise a passive element, such as a conductor, wiring, connector, electrical component, e.g. socket or plug, capacitor, inductance or resistor, and/or an active element, such as an electronic element, IC chip, or switch. The electrical element may also comprise an electrical circuit, electronic circuit, RF circuit, printed circuit, printed circuit board, antenna, circuit line, I/O port, or chip.

Overvoltage protection means for protecting electrical elements 6, 6*b*, 6*c*, 6*d*, 6*e*, 8, 9, 11-13 are disclosed, wherein the protection means comprise microvaristor particles 2. According to disclosure, single microvaristor particles 2 are placed in an arrangement 1 having a monolayer thickness t and are electrically coupled to the electrical element 6, 6*b*, 6*c*, 6*d*, 6*e*, 8, 9, 11-13 to protect the electrical element 6, 6*b*, 6*c*, 6*d*, 6*e*, 8, 9, 11-13 against overvoltages. In the following exemplary embodiments, encompassing, as well, the corresponding method steps for producing the overvoltage protection means, are presented.

FIG. 1 shows a current-voltage characteristic typical for varistor materials. Like well-known bulk varistor ceramics or varistor compounds, a microvaristor particle shows such a nonlinear behaviour of voltage versus current. Thus the microvaristor has a high resistance in normal operation and reacts almost instantaneously to overvoltages by switching into a low resistance state.

Figure 5A:
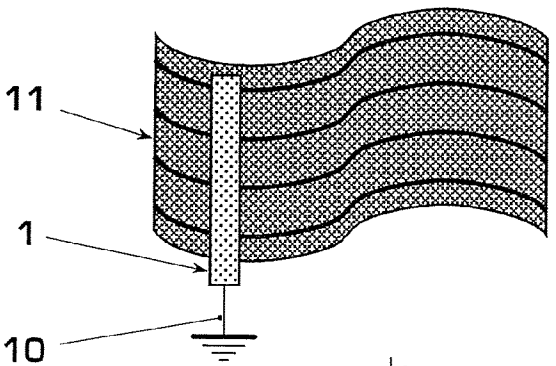
Figure 5B:
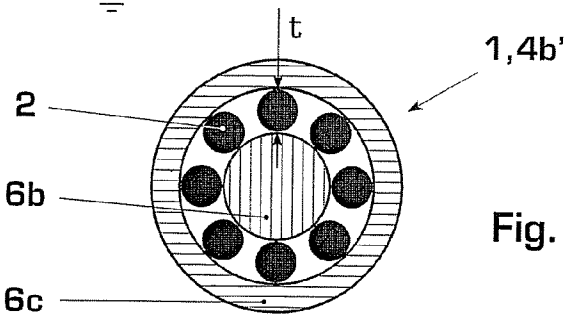
Figure 7A:
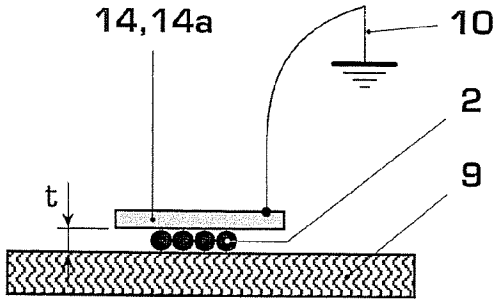
FIGS. 7*a*-7*f* embodiments of electrical contacting schemes for the microvaristor arrangement.
Figure 7B:
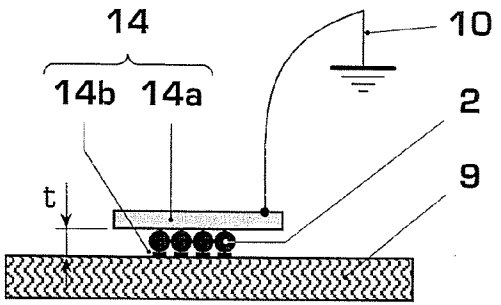
Figure 7C:
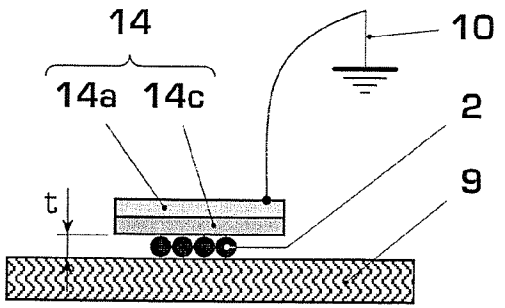
Figure 7D:
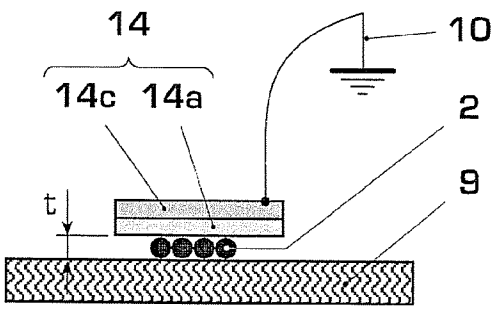
Figure 7E:
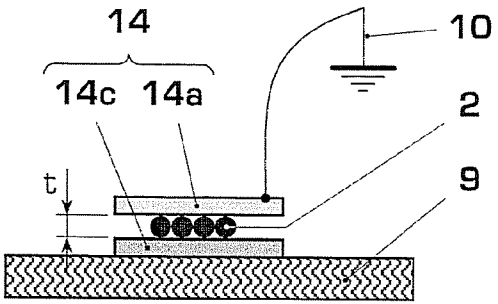
Figure 7F:
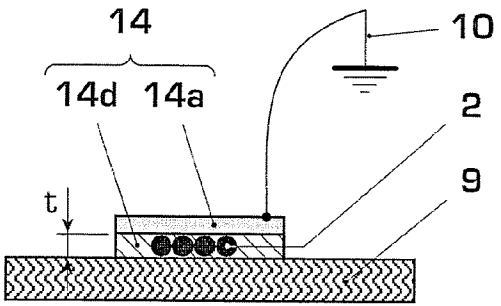
Figure 9A:
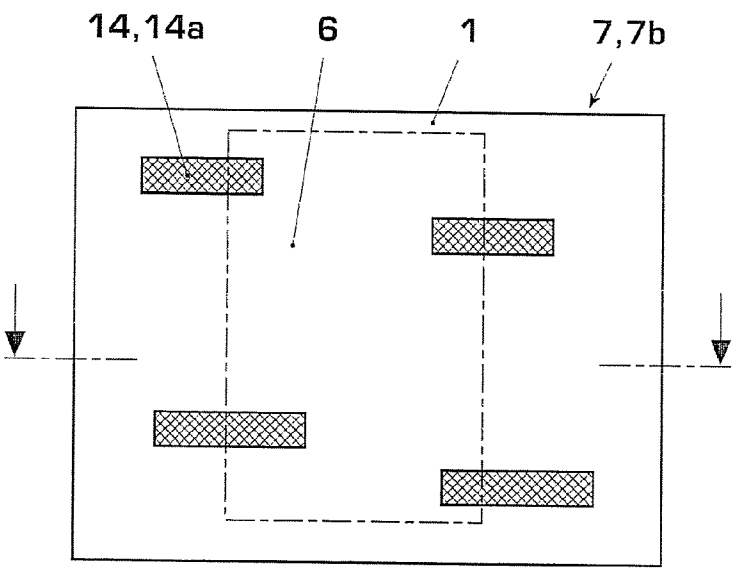
FIGS. 9*a*-9*b* further embodiments of overvoltage protection integrated on the electronic substrate.
Figure 9B:
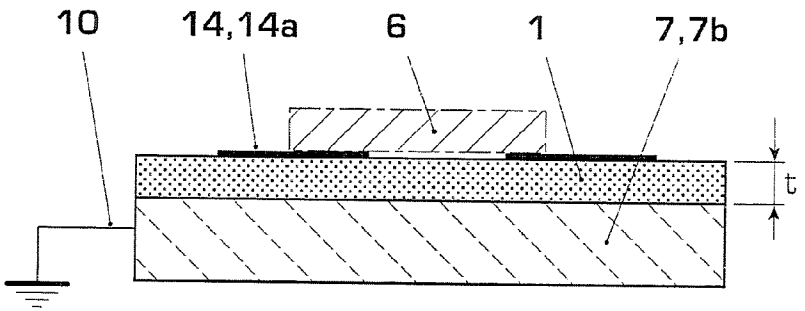

As shown in FIGS. 2*a*-2*i* the single microvaristors 2 can be arranged in a two-dimensional arrangement 1; 4*a*-4*d* (FIGS. 2*a*-2*d*) of monolayer thickness t, in particular in a plane; and/or the single microvaristors 2 are arranged along a one-dimensional or string-like arrangement 1; 4*a*', 4*b*' of monolayer thickness t, in particular in a string 1; 4*a*' extended linearly (FIG. 2*e*) and/or bent 1; 4*b*' along a conductor surface 6*b*, 6*c* (FIG. 5*b*).

The single microvaristors 2 can be arranged such that they form low-capacitance coupling points and, in particular, point-like coupling points with the electrical element 6, 6*b*, 6*c*, 6*d*, 6*e*, 8, 9, 11-13 to be protected. For example, single microvaristors 2 are arranged such that they are in direct lateral contact (FIGS. 2*a*-2*e*) and/or are separated from each other by an interstitial medium 41*g*, 41*h* (FIGS. 2*f*-2*i*), such as an insulating, semiconductive or conductive medium 41*g*, 41*h*. Preferably, single microvaristors 2 are electrically coupled and, in particular, electrically connected, to one or several neighbouring microvaristor(s) 2.

FIGS. 2*a*-2*i* and FIGS. 3*a*-3*f* show that favourably a carrier 3; 3*a*-3*j*, 3*a*' for placing the microvaristor particles (2) shall be present. The carrier 3 can be extended in a carrier plane 3*a*-3*j* and/or along a longitudinal shape, such as a groove 3*a*', edge or bent curve. The carrier 3; 3*a*-3*j* may comprise a conductive material, such as a metal, alloy, conductive ceramic or conductive polymer, and/or an insulating material, such as an insulating ceramic or insulating polymer; and/or the carrier 3; 3*a*-3*j* may be a foil 3*a*-3*c*, 3*i*, plate 3*a*-3*c*, 3*i*, mesh 3*d*, foam 3*j*, or multilayer. Favourably, the carrier 3; 3*a*-3*j* has a structure comprising individual placement sites 4; 4*a*-4*h* for single microvaristor particles 2. Preferably, the carrier 3; 3*a*-3*j* has a structured surface, which, in particular, comprises grooves 4*a*, 4*b*, holes 4*c*, 4*d*, insulating gaps 40*f*, 40*g*, insulating barriers 41*g*, 41*h*, printed ducts, or a structured plate or multilayer 4*a*, 4*b*, 4*c*, 4*g*, 4*h*.

Figure 8A:
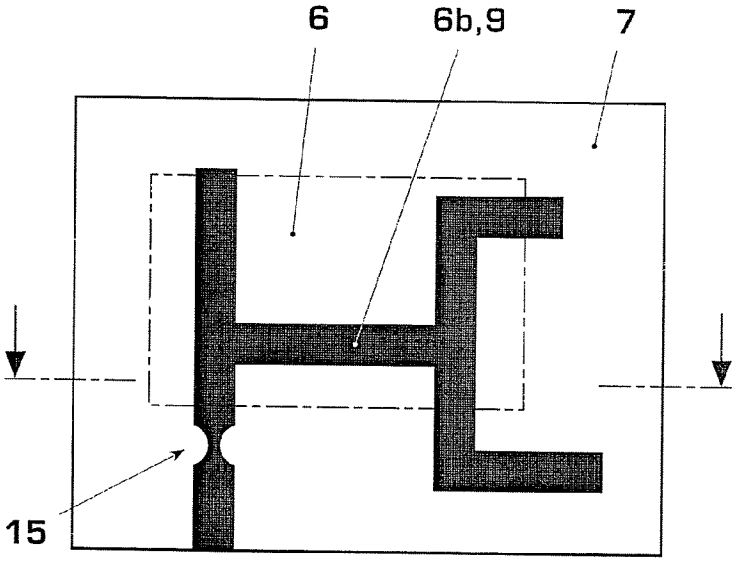
FIGS. 8*a*-8*b* embodiments of overvoltage protection integrated on the electronic substrate.
Figure 8B:
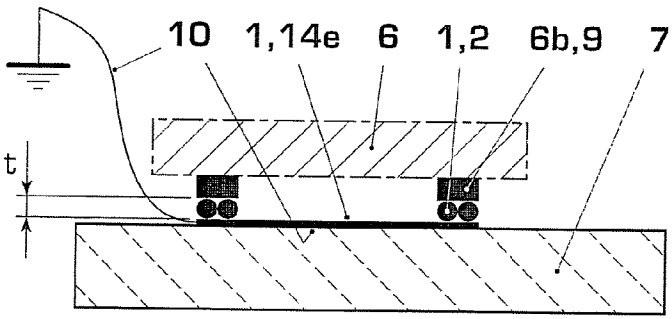

As shown in FIGS. 8*a*, 8*b* it is also possible that the carrier 3 covered with the monolayer 1 of microvaristors 2 has the function of a structured substrate 7 for an electronic circuit 6.

As shown in FIGS. 2*f*-2*i*, the carrier 3; 3*a*-3*j* can comprise guiding structures 40*f*, 40*g*, 41*g*, 41*h* for laterally and/or vertically holding the microvaristor particles 2. In particular, the guiding structures may comprise gaps 40*f*, 40*g* underneath or on top of the microvaristor particles 2 and/or barriers 41*g*, 41*h* between neighbouring microvaristor particles 2.

Figure 3A:
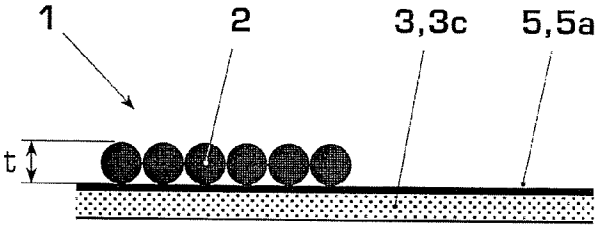
FIGS. 3*a*-3*f* embodiments of fixations of the microvaristor particles on the carrier.
Figure 3D:
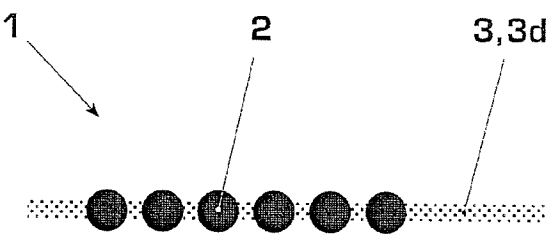
Figure 3B:
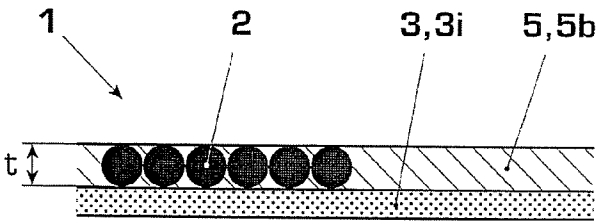
Figure 3E:
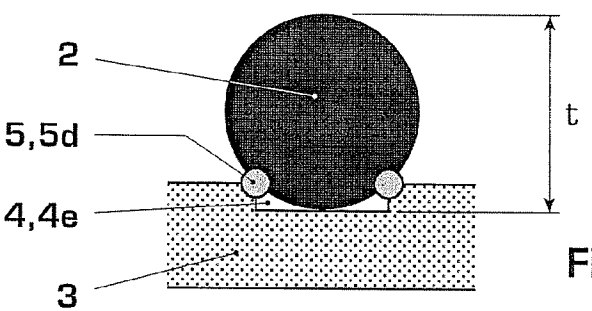
Figure 3C:
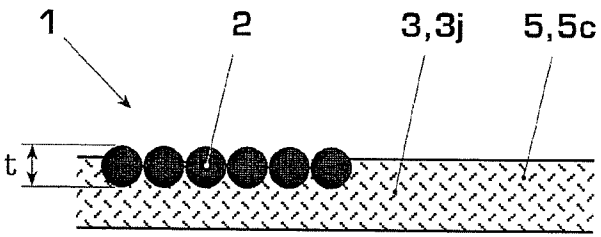
Figure 3F:
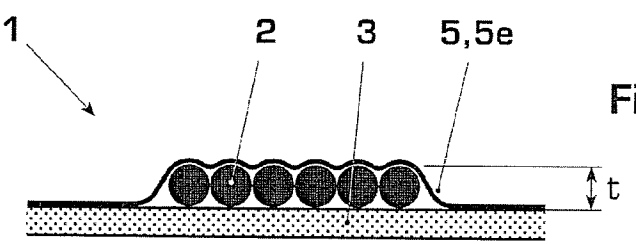

A tape 1, 3 can be formed by the monolayer microvaristor arrangement 1 backed by the carrier 3; 3*a*-3*j*, 3*a*'. FIG. 3*f* shows that the tape 1, 3, 5*e* may comprise an adhesive 53, in particular an adhesive layer 5*e*, applied to the microvaristor arrangement 1 or the microvaristor particles 2, in particular onto the microvaristor heads, for providing easy tape placement properties.

As shown in FIGS. 3*a*-3*f*, the microvaristor particles 2 can be fixed to the carrier 3; 3*a*-3*j*, 3*a*' by fixation means 5; 5*a*-5*f* and, in particular, by an adhesive 5*a* or a binder 5*b*, by pressing into a ductile carrier material 5*c*, by hot pressing into a thermoplastic carrier material 5*c*, by fusing, soldering or sintering fixation 5*d* to the carrier 3; 3*a*-3*j*, 3*a*', and/or by sealing with a thin film 5*e*, e.g. a polymer film 5*e*, onto the carrier 3; 3*a*-3*j*, 3*a*'. In particular, an adhesive 5*a* can be chosen to be conductive, anisotropically conductive, semiconductive, insulating, or is applied in a determined structure, for example by printing techniques, and in particular in a layer. As an alternative to fixation means, the microvaristor particles 2 can be pressed onto the carrier 3; 3*a*-3*j*, 3*a*'.

Figure 4:
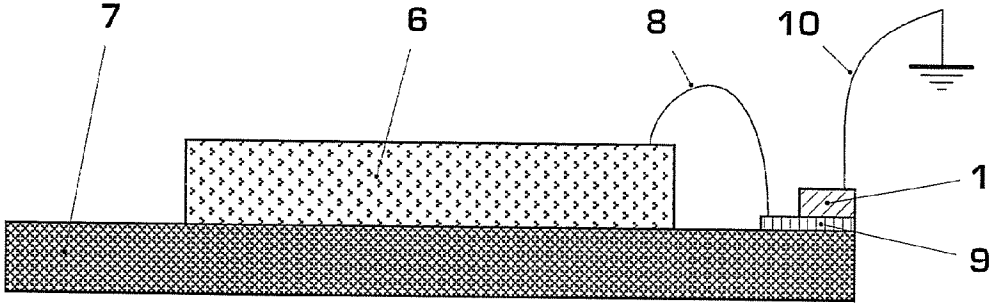
FIG. 4-6 examples of electronic elements protected by the microvaristor arrangement according to disclosure.
Figure 5C:
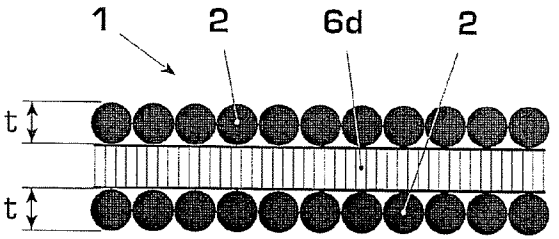
Figure 5D:
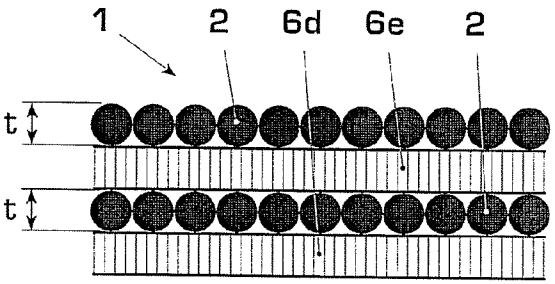
Figure 6:
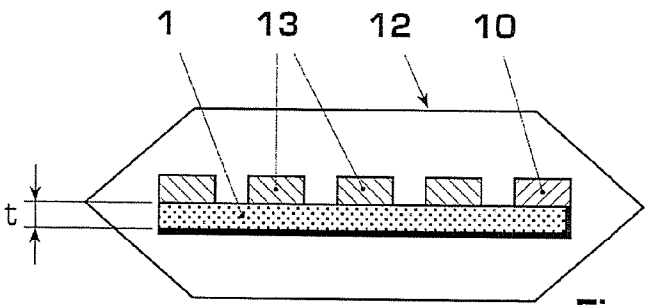

FIG. 4-6 show examples where single microvaristors 2 are arranged between a signal conductor 6*b*, 6*c*, 6*d*, 6*e*, 8, 9, 13 and a conductor 10 on a reference potential, preferably a conductor 10 on a fixed-reference potential, particularly preferred a conductor 10 on earth potential. The conductors 6*b*, 6*c*, 6*d*, 6*e*; 8, 9, 10, 13 can be coated with conducting and/or semiconductive and/or insulating material. As shown in FIGS. 5*b*-5*d* single microvaristors 2 can be arranged as a spacer between conductors 6*b*, 6*c*, 6*d*, 6*e*. In particular, single microvaristors 2 can be present in a cylindrical arrangement 1; 4*b*' between coaxial conductor cylinders 6*b*, 6*c*, in a single-sided or double-sided layer 1 on a band conductor 6*d*, or in spacer layers 1 between band conductors 6*d*, 6*e* in a multilayer arrangement 2, 6*d*, 6*e*.

The arrangement 1 of monolayer thickness t shall be electrically coupled, in particular connected, to an active part 6*b*, 6*c*, 6*d*, 6*e*, 8, 9, 11-13 and a reference-potential part 10 of the electrical component or element 6, 6*b*, 6*c*, 6*d*, 6*e*, 8, 9, 11-13 or of an assembly or device comprising the electrical element 6, 6*b*, 6*c*, 6*d*, 6*e*, 8, 9, 11-13.

FIGS. 7*a*-7*f* show examples of electrical coupling means 14; 14*a*-14*e* for effecting the desired electric coupling, including galvanic, resistive, capacitive and inductive coupling, with the lead 8 and/or the ground 10. Thus the coupling means 14; 14*a*-14*e* may comprise a conductive layer 14*a*, printed, evaporated or soldered conductive contacts 14*b*, an insulating/conductive bi-layer 14*a*, 14*c*, a conductive/insulating bi-layer 14*c*, 14*a*, a binder 14*d*, and/or a conductive, anisotropically conductive, semiconductive or insulating adhesive 14*e* and, in particular adhesive layer 14*e* (FIG. 8*b*). Such coupling means 14; 14*a*-14*e* can be arranged underneath and/or on top of the microvaristor particles 2.

A particular application is given in FIGS. 8*a*, 8*b*, where the overvoltage protection means is arranged on top of or underneath a conductor path 6*b* that has a constriction 15 for providing a fuse 15.

A preferable choice for the microvaristor particles 2 can be selected by the following criteria: the particles 2 may comprise doped ZnO and/or doped SnO and/or doped SiC and/or doped $SrTiO_3$; and/or the particles 2 may be essentially spherical or essentially hemispherical, and in particular shall have similar dimensions, preferably from some μm to some hundred μm with an upper limit of approximately 1 mm, and are preferably selected from a narrow sieving fraction; and/or the particles 2 have a platelet shape; and/or they have similar thickness; and/or they are produced by cutting, breaking and/or punching from a casted green body before or after sintering, wherein the green body is preferably tape-casted, strip-casted, extruded and/or printed, e.g. screen printed; and/or the particles 2 are produced by granulation, calcination and light breaking-up; and/or the particles 2 are decorated with metal flakes of smaller dimensions than the microvaristor dimensions. EP 0 992 042, herewith enclosed in its entirety in this application, discloses that such electrically conductive particles can be fused to the surface of the microvaristor particles to form direct electrical low resistance contacts between the microvaristor particles.

In a further aspect, the disclosure relates to an electrical device, comprising an electrical element 6, 6*b*, 6*c*, 6*d*, 6*e*, 8, 9, 11-13 having an overvoltage protection means, wherein the protection means comprise microvaristor particles 2, which are placed in an arrangement 1 having a monolayer thickness t and are electrically coupled to the electrical element 6, 6*b*, 6*c*, 6*d*, 6*e*, 8, 9, 11-13 to protect the electrical element 6, 6*b*, 6*c*, 6*d*, 6*e*, 8, 9, 11-13 against overvoltages. The overvoltage protection means can be designed as discussed in the aforementioned embodiments. In particular, as shown in FIG. 4, the monolayered overvoltage protection tape, foil or plate 1 can simply be applied or pressed against the input lead 8 of the electric device 6 to be protected, thereby saving valuable surface of the device or IC substrate 7.

In particular, as shown in FIGS. 4-6 and FIGS. 8-9, the arrangement 1 of monolayer thickness t can be present between an active part 6*b*, 6*c*, 6*d*, 6*e*, 8, 9, 11-13 and a grounded part 10 of the electrical element 6, 6*b*, 6*c*, 6*d*, 6*e*, 8, 9, 11-13 or of the electrical device; and/or the electrical element 6, 6*b*, 11-13 may comprise a passive element, such as a conductor 6*b*, 6*c*, 6*d*, 6*e*, wiring 8, connector 11, electrical component 12, 13, e.g. socket 13 or plug 12, capacitor, inductance or resistor, and/or an active element, such as an electronic element, IC chip 6, or switch; and/or the electrical device may comprise an electrical circuit, electronic circuit, RF circuit, printed circuit, printed circuit board 7, antenna, circuit line, I/O port, or chip 6.

In another aspect, the disclosure relates to a method for producing an overvoltage protection means for protecting electrical elements 6, 6*b*, 6*c*, 6*d*, 6*e*, 8, 9, 11-13, wherein the protection means comprise microvaristor particles 2. According to disclosure, single microvaristor particles 2 are placed in an arrangement 1 having a monolayer thickness t and are electrically coupled to the electrical element 6, 6*b*, 6*c*, 6*d*, 6*e*, 8, 9, 11-13 to protect the electrical element 6, 6*b*, 6*c*, 6*d*, 6*e*, 8, 9, 11-13 against overvoltages.

Exemplary embodiments of the production method relate to the features of the overvoltage protection means disclosed above. Here selected exemplary method embodiments are rementioned.

With respect to FIG. 2-3, single microvaristors 2 are placed on a carrier 3; 3*a*-3*j*, 3*a*', and, in particular, on a planar extended carrier 3; 3*a*-3*j* in the carrier plane and/or along a longitudinally extended carrier 3; 3*a*', such as a groove, edge or bent curve 3*a*'. Preferably, the carrier 3; 3*a*-3*j*, 3*a*' shall be structured such that individual placement sites 4; 4*a*-4*h* for single microvaristor particles 2 are provided for. In particular, the carrier 3; 3*a*-3*j*, 3*a*' can be structured by means of etching, punching, lasering, printing, drilling, evaporation and/or sputtering, e.g. In addition, guiding structures 40*f*, 40*g*, 41*g*, 41*h* for laterally and/or vertically holding the microvaristor particles 2 can be applied onto or into the carrier 3; 3*a*-3*j*. Such guiding structures 40*f*, 40*g*, 41*g*, 41*h* can be made of an insulating and/or semiconductive and/or conducting material, in particular of a polymer or a metal; and/or the guiding structures 40*f*, 40*g*, 41*g*, 41*h* can be applied onto the carrier 3; 3*a*-3*j*, 3*a*' by printing or sputtering, e.g.

Furthermore, an insulating adhesive 5*e*, in particular adhesive layer 5*e*, can be placed over the microvaristor arrangement 1 or microvaristor particles 2, in particular the microvaristor top sides, for providing a sticky tape 1, 3, 5*e* with easy placement properties; and/or a conductive adhesive or adhesive layer 5*e* can be applied onto the microvaristor arrangement 1, in particular by printing, spraying or roll on, for providing a sticky tape 1, 3, 5*e* with easy placement and favourable contacting properties. The adhesive or adhesive layer 5*e* can be made from the group of epoxies, silicones and (poly)urethanes. It can comprise a thermoplastic or a duromer.

The monolayered tape 1, 3 containing a monolayer of microvaristors 2 compares favourably in many respects with conventional tapes based on voluminous polymer-embedded microvaristor particles. The nonlinearity of each microvaristor particle 2 is an effect produced by its built-in grain boundaries. Owing to the monolayer arrangement 1 the overall nonlinear behaviour of the tape 1, 3 is determined by and in fact equal to the microvaristor particle nonlinearity.

The tape 1, 3 can be a flexible tape, preferably with at least one surface being self-adhesive, for applying the tape on electrical components. The tape 1, 3 can preferably be applied in electric or electronic components and provides overvoltage protection by means of its monolayer arrangement of microvaristor particles 2. With respect to the tape 1, 3, the substrate or carrier 3 can be in the form of a sheet and preferably a band.

Fixation of the microvaristor particles 2 can be effected by pressing them onto the carrier 3; 3*a*-3*j*, 3*a*. The microvaristor particles 2 can also be fixed to the carrier 3; 3*a*-3*j*, 3*a*' by fixation means 5; 5*a*-5*f*, and, in particular, by applying an adhesive 5*a* or a binder 5*b*, by pressing the microvaristors 2 into a ductile carrier material 5*c*, by hot pressing the microvaristors 2 into a thermoplastic carrier material 5*c*, by fusing, ultrasonic fusing, microwave fusing, soldering, sintering or laser sintering the microvaristors 2 to the carrier 3; 3*a*-3*j*, 3*a*', by coating or spraying metallic flakes and/or nanoparticles onto the carrier 3; 3*a*-3*j*, 3*a*' prior to fusion, soldering or sintering in order to improve adhesion and/or contacting, and/or by sealing the microvaristors 2 with a thin film 5*e*, e.g. a polymer film 5*e*, onto the carrier 3; 3*a*-3*j*, 3*a'*.

Monolayer arrangements 1 of microvaristor particles 2 allow to build overvoltage protection means that have reduced capacitance which benefits high frequency applications.

It will be appreciated by those skilled in the art that the present invention can be embodied in other specific forms without departing from the spirit or essential characteristics thereof. The presently disclosed embodiments are therefore considered in all respects to be illustrative and not restricted. The scope of the invention is indicated by the appended claims rather than the foregoing description and all changes that come within the meaning and range and equivalence thereof are intended to be embraced therein.

LIST OF REFERENCE SYMBOLS

| | |
|---|---|
| 1 | Microvaristor monolayer arrangements |
| 2 | Microvaristor particles |
| 3, 3a-3h | Carriers, structured carriers |
| 3i | Foil, plate |
| 3j | Ductile carrier, thermoplastic carrier |
| 3a-3j | planar carrier |
| 3a' | longitudinal carrier |
| 4a', 4b' | string arrangements |
| 4, 4a-4h | Microvaristor placement sites |
| 4a, 4b | Groove, elongated groove, twin groove |
| 4a', 4b' | string arrangements |
| 4c-4h | Single placement sites |
| 4d | Mesh |
| 40f, 40g | Insulating gap |
| 41g | Insulating barrier |
| 41h | Guiding structure |
| 5, 5a-5f | Fixation means |
| 5a | Adhesive |
| 5b | Binder |
| 5c | Ductile, compressible or thermoplastic carrier |
| 5d | Fusing, soldering or sintering fixation |
| 5e | Sealing fixation, thin film fixation |
| 6 | IC chip |
| 6b, 6c | Conductor path, coaxial conductors |
| 6d, 6e | Band conductors |
| 7 | IC substrate |
| 7b | Conductive IC substrate |
| 8 | Bonding wire (s) |
| 9 | Input/output pad (s), signal lead (s) |
| 10 | Grounding wire (s), grounding line |
| 11 | Connector, flexible cable with Cu traces |
| 12 | Plug |
| 13 | Plug sockets |
| 14, 14a-14f | Electrical coupling means, contacting means |
| 14a | Conductive carrier, conductive contacts |
| 14b | Screen-printed conductive contacts |
| 14c | Insulating layer |
| 14a, 14c | Insulating/conductive bi-layer |
| 14d | Binder |
| 14e | Conductive adhesive layer |
| 15 | Fuse constriction |
| t | monolayer thickness |

What is claimed is:

1. Overvoltage protection means for protecting electrical elements, wherein the protection means comprise microvaristor particles, wherein single microvaristor particles are placed in an arrangement having a monolayer thickness and are electrically coupled to the electrical element to protect the electrical element against overvoltages.

2. The overvoltage protection means as claimed in claim 1, wherein a) single microvaristors are arranged in a two-dimensional arrangement of monolayer thickness, and/or b) single microvaristors are arranged along a one-dimensional arrangement of monolayer thickness.

3. The overvoltage protection means as claimed in claim 1, wherein a) single microvaristors are arranged as a spacer between conductors.

4. The overvoltage protection means as claimed in claim 1, wherein single microvaristors are arranged between a signal conductor and a conductor on a reference potential.

5. The overvoltage protection means as claimed in claim 1, wherein the conductors are coated with conducting and/or semiconductive and/or insulating material.

6. The overvoltage protection means as claimed in claim 1, wherein single microvaristors form low-capacitance coupling points.

7. The overvoltage protection means as claimed in claim 1, wherein a) single microvaristors are arranged such that they are in direct lateral contact and/or are separated from each other by an interstitial medium, and/or b) single microvaristors are electrically coupled to one or several neighbouring microvaristor(s).

8. The overvoltage protection means as claimed in claim 1, wherein a) a carrier for placing the microvaristor particles is present, and/or b) the carrier is extended in a carrier plane and/or along a longitudinal shape.

9. The overvoltage protection means as claimed in claim 8, wherein the carrier comprises a conductive material, and/or an insulating material.

10. The overvoltage protection means as claimed in claim 8, wherein the carrier is a foil, plate, mesh, foam, or multilayer.

11. The overvoltage protection means as claimed in the claim 8, wherein a) the carrier has a structure comprising individual placement sites for single microvaristor particles, and/or b) the carrier has a structured surface, which comprises grooves, holes, insulating gaps, insulating barriers, printed ducts, or a structured plate or multilayer.

12. The overvoltage protection means as claimed in claim 8, wherein the carrier comprises guiding structures for laterally and/or vertically holding the microvaristor particles.

13. The overvoltage protection means as claimed in claim 8, wherein a) a tape is formed by the microvaristor arrangement backed by the carrier, and/or b) the tape comprises an adhesive applied to the microvaristor particles for providing an easy tape placement.

14. The overvoltage protection means as claimed in claim 8, wherein a) the microvaristor particles are pressed onto the carrier or b) the microvaristor particles are fixed to the carrier by fixation means and, by pressing into a ductile carrier material, by hot pressing into a thermoplastic carrier material, by fusing, soldering or sintering to the carrier, and/or by sealing with a thin film, onto the carrier.

15. The overvoltage protection means as claimed in claim 1, wherein the arrangement of monolayer thickness is electrically coupled to an active part and a reference-potential part of the electrical element or of a device comprising the electrical element.

16. The overvoltage protection means as claimed in claim 15, wherein the arrangement of monolayer thickness is electrically coupled to the active part and/or to the grounded part by electrical coupling means.

17. The overvoltage protection means as claimed in claim 16, wherein a) the coupling means comprise a conductive layer, printed, evaporated or soldered conductive contacts, an insulating/conductive bi-layer, a conductive/insulating bi-layer, a binder, and/or a conductive, anisotropically conductive, semiconductive or insulating adhesive layer, and/or b) the coupling means are arranged underneath and/or on top of the microvaristor particles.

18. The overvoltage protection means as claimed in claim 1, wherein the microvaristor particles comprise doped ZnO and/or doped SnO and/or doped SiC and/or doped $SrTiO_3$.

19. The overvoltage protection means as claimed in claim 1, wherein a) the microvaristor particles are essentially spherical or essentially hemispherical, such that they have similar dimensions and are selected from a narrow sieving fraction, and/or b) the microvaristor particles have a platelet shape.

20. The overvoltage protection means as claimed in claim 1, wherein the microvaristor particles are produced by granulation, calcination and light breaking-up.

21. The overvoltage protection means as claimed in claim 1, wherein the microvaristor particles are decorated with metal flakes of smaller dimensions than the microvaristor dimensions.

22. The overvoltage protection means as claimed in claim 1, wherein the overvoltage protection means is arranged on top of or underneath a conductor path that has a constriction for providing a fuse.

23. An electrical device, comprising an electrical element having an overvoltage protection means, wherein the protection means comprise microvaristor particles, wherein single microvaristor particles are placed in an arrangement having a monolayer thickness and are electrically coupled to the electrical element to protect the electrical element against overvoltages.

24. The electrical device as claimed in claim 23, wherein the overvoltage protection means comprise microvaristor particles, wherein single microvaristor particles are placed in an arrangement having a monolayer thickness and are electrically coupled to the electrical element to protect the electrical element against overvoltages.

25. The electrical device as claimed in claim 23, wherein the arrangement of monolayer thickness is present between an active part and a grounded part of the electrical element or of the electrical device.

26. The electrical device as claimed in claim 23, wherein a) the electrical element comprises a passive element, and/or an active element, and/or b) the electrical device comprises an electrical circuit, electronic circuit, RF circuit, printed circuit, printed circuit board, antenna, circuit line, I/O port, or chip.

27. A method for producing an overvoltage protection means for protecting electrical elements according to claim 1, wherein the protection means comprise microvaristor particles, the method comprising the steps of placing single microvaristor particles in an arrangement having a monolayer thickness and coupling the single microvaristor particles electrically to the electrical element to protect the electrical element against overvoltages.

28. The method as claimed in claim 27, comprising:

a) placing single microvaristors on a carrier, and, b) on a planar extended carrier in the carrier plane and/or along a longitudinally extended carrier.

29. The method as claimed in claim 28, comprising:

a) structuring the carrier such that individual placement sites for single microvaristor particles are provided for, and/or b) structuring the carrier by means of etching, punching, lasering, printing, drilling, evaporation and/or sputtering.

30. The method as claimed in claim 28, comprising:

a) applying guiding structures for laterally and/or vertically holding the microvaristor particles onto or into the carrier, and/or b) making the guiding structures of an insulating and/or semiconductive and/or conducting material, and/or c) applying the guiding structures onto the carrier by printing or sputtering.

31. The method as claimed in claim 28, comprising forming a tape by the microvaristor arrangement backed by the carrier.

32. The method as claimed in claim 31, comprising:

a) placing an insulating adhesive layer over the microvaristor arrangement for providing a sticky tape with easy placement properties, and/or b) applying a conductive adhesive onto the microvaristor particles for providing a sticky tape with easy placement and contacting properties.

33. The method as claimed in claim 27, comprising:

a) pressing the microvaristor particles onto the carrier or b) fixing the microvaristor particles to the carrier by fixation means.

34. The overvoltage protection means as claimed in claim 2, wherein a) single microvaristors are arranged as a spacer between conductors, and b) single microvaristors are present in a cylindrical arrangement between coaxial conductor cylinders, in a single-sided or double-sided layer on a band conductor, or in spacer layers between band conductors in a multilayer arrangement.

35. The overvoltage protection means as claimed in claim 3, wherein single microvaristors are arranged between a signal conductor and a conductor on a reference potential.

36. The overvoltage protection means as claimed in claim 4, wherein the conductors are coated with conducting and/or semiconductive and/or insulating material.

37. The overvoltage protection means as claimed in claim 5, wherein single microvaristors form low-capacitance coupling points.

38. The overvoltage protection means as claimed in claim 6, wherein a) single microvaristors are arranged such that they are in direct lateral contact and/or are separated from each other by an interstitial medium, and/or b) single microvaristors are electrically coupled to one or several neighbouring microvaristor(s).

39. The overvoltage protection means as claimed in claim 7, comprising one of:

a) a carrier for placing the microvaristor particles, b) a carrier for placing the micro-varistor particles, the carrier extending in at least one of a carrier plane, along a longitudinal shape, along a groove, along an edge, and along a bent curve.

40. The overvoltage protection means as claimed in claim 9, wherein the carrier is a foil, plate, mesh, foam, or multilayer.

41. The overvoltage protection means as claimed in the claim 10, wherein a) the carrier has a structure comprising individual placement sites for single microvaristor particles, and/or b) the carrier has a structured surface, which, comprises grooves, holes, insulating gaps, insulating barriers, printed ducts, or a structured plate or multilayer.

42. The overvoltage protection means as claimed in claim 11, wherein a) the carrier comprises guiding structures for laterally and/or vertically holding the microvaristor particles, and b) the guiding structures comprise gaps underneath or on top of microvaristor particles and/or barriers between neighbouring microvaristor particles.

43. The overvoltage protection means as claimed in claim 13, wherein a) the microvaristor particles are pressed onto the carrier or b) the microvaristor particles are fixed to the carrier by fixation means and, by pressing into a ductile carrier material, by hot pressing into a thermoplastic carrier material, by fusing, soldering or sintering to the carrier, and/or by sealing with a thin film onto the carrier, and c) an adhesive is conductive, anisotropically conductive, semiconductive, insulating, or is applied in a determined structure.

44. The overvoltage protection means as claimed in claim 14, wherein the arrangement of monolayer thickness is electrically coupled to an active part and a reference-potential part of the electrical element or of a device comprising the electrical element.

45. The overvoltage protection means as claimed in claim 17, wherein the microvaristor particles comprise doped ZnO and/or doped SnO and/or doped SiC and/or doped $SrTiO_3$.

46. The overvoltage protection means as claimed in claim 18, wherein a) the microvaristor particles are essentially spherical or essentially hemispherical, and/or b) the microvaristor particles have a platelet shape.

47. The overvoltage protection means as claimed in claim 19, wherein the microvaristor particles are produced by granulation, calcination and light breaking-up.

48. The overvoltage protection means as claimed in claim 20, wherein the microvaristor particles are decorated with metal flakes of smaller dimensions than the microvaristor dimensions.

49. The overvoltage protection means as claimed in claim 21, wherein the overvoltage protection means is arranged on top of or underneath a conductor path that has a constriction for providing a fuse.

50. The electrical device as claimed in claim 24, wherein the arrangement of monolayer thickness is present between an active part and a grounded part of the electrical element or of the electrical device.

51. The electrical device as claimed in claim 25, wherein a) the electrical element comprises a passive element, and/or an active element, and/or b) the electrical device comprises an electrical circuit, electronic circuit, RF circuit, printed circuit, printed circuit board, antenna, circuit line, I/O port, or chip.

52. A method for producing an overvoltage protection means for protecting electrical elements according to claim 22, wherein the protection means comprise microvaristor particles, and wherein the method further comprises the steps of placing single microvaristor particles in an arrangement having a monolayer thickness and coupling the single microvaristor particles electrically to the electrical element to protect the electrical element against overvoltages.

53. The method as claimed in claim 29, comprising:

a) applying guiding structures for laterally and/or vertically holding the microvaristor particles onto or into the carrier, and performing at least one of:

i) making the guiding structures of an insulating and/or semiconductive and/or conducting material, ii) making the guiding structures of a polymer or a metal, and iii) applying the guiding structures onto the carrier by printing or sputtering.

54. The method as claimed in claim 30, comprising forming a tape by the microvaristor arrangement backed by the carrier.

55. The method as claimed in claim 32, comprising:

a) pressing the microvaristor particles onto the carrier or b) fixing the microvaristor particles to the carrier by fixation means.

56. The overvoltage protection means as claimed in claim 2, wherein a) the two-dimensional arrangement of monolayer thickness is a plane, and b) the one dimensional arrangement of monolayer thickness is a string extended linearly and/or bent along a conductor surface.

57. The overvoltage protection means as claimed in claim 3, wherein the single microvaristors are present in a cylindrical arrangement between coaxial conductor cylinders, in a single-sided or double-sided layer on a band conductor, or in spacer layers between band conductors in a multilayer arrangement.

58. The overvoltage protection means as claimed in claim 6, wherein the low-capacitance coupling points are point-like coupling points with the electrical element.

59. The overvoltage protection means as claimed in claim 19, wherein the microvaristor particles are at least one of:

a) a similar thickness;

b) produced by at least one of cutting, breaking, and punching from a casted green body before or after sintering; and c) produced by at least one of cutting, breaking, and punching from a casted green body before or after sintering, the green body being at least one of tape-casted, strip-casted, extruded, printed, and screen printed.

60. The method as claimed in claim 30, wherein the guiding structures comprise a polymer or a metal.

61. The method as claimed in claim 33, wherein a) the fixing of the microvaristor particles to the carrier by fixation means is by at least one of:

i) applying an adhesive or a binder, ii) pressing the microvaristors into a ductile carrier material, iii) hot pressing the microvaristors into a thermoplastic carrier material, iv) fusing, v) ultrasonic fusing, vi) microwave fusing, vii) soldering, viii) sintering, ix) laser sintering the microvaristors to the carrier, x) coating or spraying metallic flakes and/or nano-particles onto the carrier prior to fusion, xi) soldering or sintering in order to improve adhesion and/or contacting, xii) sealing the microvaristors with a thin film onto the carrier, and xiii) sealing the microvaristors with a thin polymer film onto the carrier.

62. The method as claimed in claim 35, wherein the reference potential is one of a fixed reference potential and earth potential.

63. The overvoltage protection means as claimed in claim 46, wherein the microvaristor particles are at least one of:

a) similar dimensions and selected from a narrow sieving fraction, b) similar thickness, c) produced by at least one of cutting, breaking, and punching from a casted green body before or after sintering, d) produced by at least one of cutting, breaking, and punching from a casted green body before or after sintering, the green body being at least one of tape-casted, strip-casted, extruded, screen printed and printed.

* * * * *